United States Patent [19]

Johnson

[11] 3,963,593

[45] June 15, 1976

[54] ELECTRODES HAVING SILICIDE SURFACE

[75] Inventor: Harlan B. Johnson, Rittman, Ohio

[73] Assignee: PPG Industries, Inc., Pittsburgh, Pa.

[22] Filed: Nov. 13, 1974

[21] Appl. No.: 523,397

Related U.S. Application Data

[62] Division of Ser. No. 289,700, Sept. 15, 1972, Pat. No. 3,862,023.

[52] U.S. Cl. ..... 204/98; 204/242; 204/290 F

[51] Int. Cl.[2] ..... C25B 1/34; C25B 11/08; C25B 11/10

[58] Field of Search ..... 204/290 R, 290 F, 291, 204/98

[56] References Cited

UNITED STATES PATENTS

| | | | |
|---|---|---|---|
| 3,297,436 | 1/1967 | Duwez | 75/172 R X |
| 3,491,014 | 1/1970 | Bianchi et al. | 204/242 |
| 3,645,862 | 2/1972 | Cotton et al. | 204/56 R |
| 3,657,102 | 4/1972 | Keith et al. | 204/290 F |
| 3,663,414 | 5/1972 | Martinsons et al. | 204/290 F |
| 3,852,175 | 12/1974 | Hockje | 204/98 |

FOREIGN PATENTS OR APPLICATIONS

| | | | |
|---|---|---|---|
| 1,801,402 | 5/1970 | Germany | 204/290 F |

*Primary Examiner*—F.C. Edmundson
*Attorney, Agent, or Firm*—Richard M. Goldman

[57] ABSTRACT

An electrode is disclosed having an electroconductive silicide surface on a suitable electroconductive substrate. The silicide surface is electroconductive and electrocatalytic. Also disclosed is an electrolytic cell containing an anode having a silicide surface on a suitable electroconductive substrate and an electrolytic process for the electrolysis of brines by the use of such an anode.

10 Claims, No Drawings

ELECTRODES HAVING SILICIDE SURFACE

This is a division of application Ser. No. 289,700, filed Sept. 15, 1972, now U.S. Pat. No. 3,862,023.

BACKGROUND OF THE INVENTION

In the past electrodes for the electrolysis of brines have been bulk graphite slabs or plates. While such graphite slabs and plates are characterized by having satisfactory electroconductivity, they are subject to attack by the electrode products, to erosion, and to ultimate destruction in service.

To a significant extent, bulk graphite slabs have now been replaced by metallic electrodes. In their most common form, metallic electrodes have a valve metal base with an electroconductive surface. The electroconductive of valve metal substrates that have been used include the valve metals, i.e., titanium, tantalum, tungsten, niobium, zironcium, aluminum, and berylium. Most frequently, titanium substrates have been used.

The valve metal electrodes of the prior art have most commonly had precious metal surfaces. These surfaces have typically been the platinum metals in the metalic state, i.e., platinum, iridium, osmium, palladium, rhodium, and ruthenium. Alternatively, the electroconductive surfaces of these valve metal electrodes of the prior art have included oxides of the platinum group metals as well as other oxygen-containing compounds of the platinum group metals.

SUMMARY OF INVENTION

It has now surprisingly been found that electrodes having an electroconductive, electrolyte-resistant substrate or base and an electroconductive, anolyte-resistant silicide surface provide particularly satisfactory electrodes for the electrolysis of brines.

DESCRIPTION OF THE INVENTION

According to this invention, an electrode is provided having an electroconductive, electrocatalytic silicide surface on a electroconductive substrate. Such an electrode is useful for the electrolysis of brines, particularly aqueous solutions of alkali metal chlorides such as sodium chloride and potassium chloride. The silicides useful in providing the electroconductive, electrocatalytic surface of the electrode of this invention are those silicides having a satisfactory electroconductivity, an electrocatalytic effect in the evolution of chlorine, and chemical resistance to the anolyte and to the evolved anodic product. Such a silicide-containing surface may, moreover, be a combination of two or more silicides, both characterized by substantial resistance to chemical attack by the anolyte and the evolved anodic product, but only one of which has a high electrical conductivity and an electrocatalytic effect in the evolution of chlorine.

By electrocatalytic effect in the evolution of chlorine, is meant that the chlorine overvoltage of the silicide surface at a current density of 500 amperes per square foot is less than about 0.25 volts and preferably less than about 0.15 volts. Satisfactory electroconductive, electrocatalytic, electrolyte-resistant silicides include silicides of the platinum group metals; that is, platinum silicide, $Pt_3Si$, $Pt_5Si_2$, $Pt_2Si$, $Pt_2Si_2$, and PtSi, palladium silicide, $Pd_3Si$, $Pd_2Si$, and PdSi, irridium $Ir_3Si_2$, IrSi, $Ir_2Si_3$, and $IrSi_3$, rhodium silicide, $Rh_3Si_2$, RhSi, $Rh_2Si_3$ and $RhSi_3$, ruthenium silicide, $Ru_3Si_2$, RuSi, and $Ru_2Si_3$, and osmium silicide, $Os_2Si_3$, and OsSi.

The preferred platinum group metal silicides are those rich in the platinum metal stoichiometric content, e.g., $Pt_3Si$, $Pd_3Si$, $Ir_3Si_2$, $Rh_3Si_2$ and $Ru_3Si_2$. Particularly preferred among the platinum group metal silicides rich in the platinum group metal stoichiometric content are compositions of the platinum group metal and the silicides thereof. These compositions are variously reported in the literature as being eutectics of the platinum group metal and the silicide thereof, peritectics of the platinum group metal and the silicide thereof, intermetallic compounds of the platinum group metal and the silicide thereof, and solid solutions of the platinum group and the silicide thereof. These compositions of the platinum group metal and the silicide thereof contain in excess of 65 atomic percent of the platinum group metal, both combined and uncombined, based on total platinum group metal and silicon. Most frequently, they will contain from about 75 atomic percent of the platinum group metal, to about 98.5 atomic percent of the platinum group metal. These compositions of the platinum group meta and the silicide thereof do not readily undergo phase changes or crystallographic changes under normal cell operating conditions, and are resistant to attack by the electrolyte. Exemplary of this class of platinum group metal - platinum group metal silicide compositions is a comparison containing in excess of 75 atomic percent platinum, as $Pt_3Si$, platinum and various higher platinum silicides. A particularly outstanding electrocatalytic material is a composition containing 77 atomic percent platinum, and having a melting point of about 830° C. This composition is reported by R. Gohle and K. Schubert, "Zum Aufbau des Systems Platin-Silizium." *Z. Metallk.*, 55, 503 (1964) to be a solid solution of $Pt_3Si$ and metallic platinum.

Another particularly outstanding electrocatalytic material is a composition containing approximately 84 atomic percent palladium and approximately 16 atomic percent silicon. This composition is reported by A. S. Berezhoni, *Silicon and its Binary Systems*, Consultants Bureau, N.Y. (1960), to contain $Pd_3Si$ and Pd. Another particularly outstanding electrocatalyst is $Ru_3Si_2$, either as $Ru_3Si_2$ or in combination with Ru. Electrode coatings containing such compositions, including $Pd_3Si$, $Pt_3Si$, and $Ru_3Si_2$, are particularly preferred.

Other silicides having a satisfactory chlorine overvoltage, and a sufficiently high electrical conductivity and chemical resistance to the anolyte products to be useful in providing the electrode coating of this invention include: $TiSi_2$, $ZrSi_2$, $VSi_2$, $NbSi_2$, $TaSi_2$, $WSi_2$, $Cr_3Si$, $CrSi_2$, and $MoSi_2$. Of the transition metal silicides other than the silicides of the platinum group metals, the silicides of the Group VI B elements, e.g., chromium, molybdenum, and tungsten, appear to be particularly outstanding anode materials. Particularly preferred among the silicides of the Group VI B elements are $CrSi_2$, $MoSi_2$ and $WSi_2$.

According to one exemplification of this invention, the entire surface of the electrode contains the electrocatalytic silicide. According to yet another exemplification of this invention, the only silicide present on the surface in substantial quantity is the electrocatalytic, electroconductive silicide, but the silicide covers only a fraction of the exposed surface of the electrode. For example, the only silicide present on the surface of the electrode may be platinum silicide or palladium silicide, and the platinum silicide or palladium silicide may only cover a fraction of the electrode surface, thereby leaving portions of the surface of the electrode exposed to and in contact with the electrolyte. According to this exemplification, the silicide need only cover from about ¼ to 1 percent to about 1 percent up to about 5 percent or even higher,, for example, for about 98 percent or 100 percent of the surface area of the electrode. Thus, as the substrate is a valve metal, such as titanium or tantalum, the valve metal surface exposed to the electrolyte will be converted to the oxide of the valve metal.

According to yet another exemplification of this invention, the electroconductive, electrocatalytic silicide is present on the surface of the electrode in combination with silicides of lower conductivity, or silicides of lower electrocatalytic effect, i.e., higher chlorine overvoltage. For example, the electroconductive, electrocatalytic silicide such as $Pt_3Si$ may be present on the surface of the electrode in combination with a silicide of lower electroconductivity or lower electrocatalytic effect such as PtSi. In this way, from ¼ of 1 percent to about 1 percent or higher, for example 5 percent, or even as high as 90 or 100 percent of the surface of the anode is coated with silicide but only a small fraction of silicide is electrocatalytic. For example, only about 1 or 2 percent, or more, for example, 50 percent, or even as high as 90 percent of the silicide is the electrocatalytic silicide. An electrode prepared according to this exemplification would have a surface containing platinum silicide, with a minor part of the platinum silicide being the electroconductive, electrocatalytic $Pt_3Si$; and a major portion of the silicide being the electroconductive PtSi. In this way the non-electrocatalytic silicide, or silicide of lower electrocatalytic effect provides added surface area for surface-catalyzed reactions of the anode products, for example the combination of neutral chlorine atoms to form neutral chlorine molecules, while further providing added durability to the anode surface.

According to still a further exemplification of this invention, other materials chemically resistant to the anolyte may be present on the electroconductive surface without deleterious effects. Oxides of the metals present as the silicides may be present on and in the electrocatalytic surface without deleterious effects and may also provide added surface area and surface catalytic effect to the electrode. Furthermore, such materials may also provide additional electrocatalytic effect. For example, the oxides of the platinum group metals may be present on the surface of the electrode in combination with the silicides thereof. According to this exemplification, the surface of the electrode may include both platinum oxide and platinum silicide, e.g., $Pt_3Si$. Furthermore, the surface of the electrode may include the oxide of the metal present as the electrocatalytic silicide, and also the silicide and the oxide of the material of lower electrocatalytic effect. Thus, an electrode may be prepared contaning platinum oxide, and platinum silicide, $Pt_3Si$, as well as titanium dioxide and titanium silicide, such as $TiSi_2$ or $Ti_2Si_5$.

Additionally, the silicides may be used to provide an electroconductive layer on the electroconductive base or substrate with the silicide surface having a further exterior coating of a suitable catalytic material, the catalytic material being either a surface catalyst or electrocatalyst material, or both a surface catalyst and an electrocatalyst. For example, the exterior surface may be an electrocatalyst having a low chlorine overvoltage with the silicide providing a corrosion-resistant electroconductive layer between the exterior surface and the substrate, protecting the substrate from corrosion. Thus an electrode may be provided having a corrosion-resistant, electroconductive silicide, such as the higher silicides of platinum, e.g., PtSi, $PtSi_2$, or the silicides of the other transition metals such as interposed between the substrate and a more electrocatalytic exterior surface, such as $Bi_2Ru_2O_7$, $Bi_2Rh_2O_7$, $Bi_2Ir_2O_7$, $PtCoO_2$, $PdCoO_2$, $PdCrO_2$, $PdPbO_2$, and the like. Typically such intermediate silicide layers will be from 5 to 300 micro inches thick, and the exterior electrocatalytic surface will be from 5 to 800 micro inches thick, and most frequently from 180 to 300 micro inches thick.

Alternatively, the external layer may be a surface catalyst such as a bimetal spinel, e.g., $CoAl_2O_4$, $NiAl_2O_4$, $FeAlFeO_4$, $FeAl_2O_4$, or the like. According to the exemplification where a surface catalyst is provided atop the electroconductive, electrocatalytic silicide, the electrode will have a layer of the silicide, e.g., $Pt_3Si$, from 5 to about 300 micro inches thick on a titanium substrate with an external coating, atop the silicide of $CoAl_2O_4$, having a porosity of from 0.50 to about 0.80 or 0.85, and a thickness of from about 100 to about 800 micro inches.

According to still a further exemplification, non-conductive oxides such as silicon dioxide, and oxides of the valve metals, such as titanium dioxide, may be present on or in the silicide surface. Such materials may serve to provide sites for surface-catalyzed reactions, as well as providing further mechanical durability and abrasion resistance to the electrocatalytic coating. Such materials may be present either as a compact, dense mass on the surface of the substrate, included with the electrocatalytic materials, or, they may be present as a porous layer on top of the electrocatalytic surface between the electrocatalytic surface and the electrolyte. According to the exemplification where such materials are present as a porous external layer, the layer will typically have a porosity of from about 0.50 to about 0.9 or 0.95 and a thickness of from 60 to 800 micro inches allowing the flow of electrical current and electrolyte therethrough. In this way the porous external surface protects the electrocatalytic surface from mechanical damage, provides abrasion resistance, and acts as a further additional site for surface-catalyzed reactions.

As described hereinabove, while the silicide-coated electrodes of this invention may include an electrode that is a solid bulk silicide mass, such electrodes will not normally be utilized for reasons of economy. Preferably, the silicide electrodes of this invention will be in the form of an electrode having a silicide surface on a suitable electroconductive substrate.

By "suitable electroconductive substrates of base members" is meant a substrate having an electrical conductivity within economic limits for its intended use, e.g., $10^2$ (ohm-centimeters)$^{-1}$ or higher, and being substantially non-reactive with the electrolyte and the products of electrolysis. For example, in the electrolysis of brines, a suitable electroconductive substrate would be one that is substantially non-reactive with sodium hydroxide, sodium chloride, or hydrochloric acid solutions and not attacked by nascent chlorine.

The preferred electroconductive substrate or base materials are the valve metals. The valve metals are those metals which form an oxide film under anodic conditions. The valve metals include titanium, tantalum, niobium, hafnium, tungsten, aluminum, zirconium, vanadium, and alloys thereof. For reasons of costs and availability, titanium and titanium alloys are preferred as the substrate for the electrodes of this invention.

Where the electrodes of this invention are intended for use in chlor-alkali cells, the valve metal substrates are substantially impervious to the electrolyte. That is, the valve metal base is characterized by the substantial absence of pores and interstices such that the interior of the valve metal base is not wet by the electrolyte. However, the electrodes of this invention may be in the form of arrays of rods and bars, or in the form of mesh or perforate or foraminous sheets, thereby allowing for passage of electrolyte and gases around the electrode structure. Such electrodes, while themselves microscopically electrolyte permeable to the bulk flow of electrolyte have members that are microscopically impermeable to the flow of electrolyte.

Alternatively, other materials such as graphite or carbon may be used as the electroconductive substrate or base material without deleterious effects. A laminate of a valve metal and a less expensive metal such as iron or steel may be used with the silicide coating on the valve metal. For example, an electrode may be provided forming a 1/32 inch thick titanium sheet bonded to a steel plate, with a to 300 microinch thick silicide surface on the titanium sheet.

Alternatively, titanium hydride or other electroconductive, anodically-resistant hydrides may be used as the electroconductive substrate or base member of the electrode of this invention. The hydride may be present as the sole base member, or it may be in the form of a plate of the hydride on another material. For example, the hydride may be present as a hydride surface of the metal used in providing the base, e.g., a titanium base with a titanium hydride layer between the titanium metal base and the silicide surface.

A layer of an electroconductive material more conductive than the silicide and also resistant to the electrolyte may be interposed between the silicide and the substrate or base member. Such intermediate layer may be a platinum group metal such as metallic ruthenium, rhodium, palladium, osmium, iridium, or platinum or alloys thereof. Particularly satisfactory alloys include platinum-palladium alloys.

Electrodes of this invention, having a silicide surface on a valve metal base may be prepared by a variety of exemplifications. According to a preferred exemplification, the materials useful in providing the electrocatalytic silices are applied to the base member in the form of finely ground particles admixed with finely ground metallic silicon to form a thin coat and therafter annealed in the substantial absence of oxygen to form the silicide. The thin coat may be applied by electrodeposition, electrolessdeposition, vacuum sputtering, thermal decomposition of organic compounds of the materials used in forming the silicides, metallic cementation, or any other method for providing such a coating. Thereafter, the electrode, including the powdered silicon and the material to be converted to the silicide are heated in the absence of oxygen to a temperature sufficiently high to form the silicide.

The heating to form the silicide may occur at a temperature of from about 400° to about 800°C., or even higher. Most commonly, this heating will take place at a temperature of about 450° to about 750°C.

At a temperature of 550°C., approximately 72 hours are required for the beginning of platinum silicide formation.

However, when the electrode coating is a composition of a platinum group metal with the silicide thereof, e.g., $Pt_3Si$ and Pt, $Pd_3Si$ with Pd or $Ru_3Si_2$ with Ru, as described hereinabove, temperatures in excess of 800°C. are required in order to form the silicide. In the formation of $Pt_3Si$ with Pt, temperatures greater than 830°C. are required. For example, while the composition itself has a melting or fusing point of 830°C. temperatures of from about 835° to about 875°C. are normally required in order to attain formation of the composition within a reasonable time.

Furthermore, the formation of the $Pt_3Si$ - Pt-type composition requires intimate contact between the platinum and the silicon. Thus, because of the temperatures involved and the kinetics of the formation reaction including rates of diffusion, it is not normally feasible to form the $Pt_3Si$ and $Pd_3Si$-type surfaces on the electrode. Therefore, it is preferred that the silicide be pre-formed and thereafter applied to the electrode. Thus, in order to obtain sufficient amount of $Pt_3Si$ it is desirable to provide the platinum and silicon in a fine state of comminution having a high surface area per unit of mass, e.g., a mixture of minus 325 mesh platinum and minus 325 mesh silicon. This mixture is then heated in the absence of oxygen to 835°C. or higher for a sufficient time to attain formation of the composition. The resulting composition, normally a solid mass is then reduced in size, e.g., by crushing, grinding, or hammering, to obtain particles which may then be applied to the electrode base by methods well-known in the art, e.g., printing, electroless deposition, electrodeposition, cathodic electrophoresis, or the like followed by vaporization or thermal decomposition of the solvent or liquid carrier to provide an adherent coating of the silicide. Additives, binders, and the like, may be combined with the silicide as described hereinabove.

Although this invention has been described with particular reference to anodes for electrolysis of aqueous alkali metal chloride solutions, it is not limited to such use. The anodes herein contemplated may be used in electrochemical reactions wherever a corrosion-resistant anode of at least one having long life is desired. Thus, the electrolyte in the cell may be a salt of a metal which is to be electrodeposited, and the electrolyte may be electrolyzed between the silicide-coated anode and a cathode to electrodeposit the metal on the cathode. Copper, nickel, iron, manganese and the like may be so deposited from salt solutions. The electrolytic oxidation of organic compounds, e.g., propylene, to propylene oxide or propylene glycol, may be performed using such anodes. Moreover, metal structures, such as ships' hulls, may be cathodically protected using these anodes. In each case, the cell comprises the silicide coated anode herein contemplated, a cathode, and a means to establish an external voltage or electromotive force between the anode and the cathode whereby the anode is positively charged with reference to te cathode.

EXAMPLE I

An anode was prepared having a triplatinum silicide, $Pt_3Si$, surface on a graphite substrate, to test the overvoltage of $Pt_3Si$.

The triplatinum silicide was prepared from platinum black and silicon powder. A mixture of 2.000 grams of platinum black and 0.0960 grams of minus 325 mesh silicon was prepared. This mixture was ground in a mortar and pestle and then pressed into ¼ inch diameter cylinders.

The cylinders were placed in an alundum boat, which was then placed in a 15 millimeter by 5 inch quartz tube. The tube was evacuated for 16 hours at 25°C. and then sealed. The sealed quartz tube, containing the mixed powder cylinders, was then heated to between 830° ad 835°C. for 43 minutes.

The resulting silvery sintered material, $Pt_3Si$, was broken into small pieces and then ground in tungsten carbide mortar and pestle. A slurry was then prepared containing 0.10 gram of $Pt_3Si$, 0.10 gram of a solution of titanium trichloride, $TiCl_3$, in ethanol containing 4.5 weight percent titanium calculated as the metal, 0.10 gram of ethanol, and 0.10 gram of phenol. One coat of this was applied to a graphite coupon. The coupon was heated to 120°C. for 60 minutes and then to 400°C. for 30 minutes.

The resulting electrode, having a triplatinum silicide, $Pt_3Si$, surface containing titanium dioxide, $TiO_2$, on a graphite substrate, was utilized as an anode in a laboratory chlorine cell. Electrolysis was commenced and chlorine was seen to be evolved.

At a current density of 100 amperes per square foot, the chlorine overvoltage was 0.05 volt. At a current density of 200 amperes per square foot, the chlorine overvoltage was 0.09 volt, and at a current density of 500 amperes per square foot the chlorine overvoltage was 0.19 volt. These overvoltages are lower tha the chlorine overvoltages of graphite, indicating an electrolytic effect.

EXAMPLE II

An anode was prepared having a triplatinum silicide, $Pt_3Si$, surface on a graphite substrate, to test the overvoltage of $Pt_3Si$.

A slurry was prepared containing 0.10 gram of the triplatinum silicide prepared in Example I, 0.20 gram of a solution of titanium trichloride, $TiCl_3$, in ethanol containing 4.5 weight percent titanium calculated as a metal, and 0.15 gram of phenol.

One coat of the slurry was applied to a graphite coupon. The coupon was then heated to 400° centigrade for 30 minutes.

The resulting electrode, having a triplatinum silicide, $Pt_3Si$, surface containing titanium dioxide, on a graphite substrate, was utilized as an anode in a laboratory chlorine cell. Electrolysis was commenced and chlorine was seen to be evolved.

EXAMPLE III

An electrode is prepared having a triplatinum silicide ($Pt_3Si$) surface on a titanium substrate.

The triplatinum silicide is prepared from platinum black and silicon powder. A mixture of 2.000 grams of platinum black and 0.096 grams of minus 325 mesh silicon is prepared. This mixture is ground in a mortar and pestle and then pressed into ¼ inch diameter cylinders.

The cylinders are placed in an alundum boat, which is then placed in a 15 millimeter by 5 inch quartz tube. The tube is evacuated for 16 hours at 25° C and then sealed. The sealed quartz tube is then heated to approximately 835° C for 45 minutes.

The resulting silvery gray $Pt_3Si$ is broken into small pieces and ground in a tungsten carbide mortar and pestle.

A 5 ¾ inch by ⅜ inch by ⅛ inch titanium coupon is washed in Comet (TM) household cleanser, rinsed in distilled water and dipped in one weight percent hydrofluoric acid for one minute. Thereafter, the coupon is etched in twelve normal hydrochloric acid at 27° C for 23 hours.

A slurry is then prepared containing 0.10 grams of $Pt_3Si$, 0.10 gram of a solution of titanium trichloride, $TiCl_3$, in ethanol containing 4.5 weight percent titanium calculated as the metal, 0.10 gram of ethanol, and 0.10 gram of phenol. One coat of this is applied to the titanium coupon. The coupon is then heated to 120°C. for 60 minutes and to 400°C. for 30 minutes.

When the resulting electrode, having a $Pt_3Si$ surface containing $TiO_2$ on a titanium substrate is utilized as an anode in a laboratory chlorine cell, chlorine is seen to be evolved.

EXAMPLE IV

An electrode is prepared having a tripalladium silicide ($Pd_3Si$) surface on a titanium substrate.

The tripalladium silicide is prepared from minus 325 mesh palladium powder and silicon powder. A mixture of 2.000 grams of palladium powder and 0.082 grams of minus 325 mesh silicon is prepared. The mixture is ground in a mortar and pestle and then pressed into ¼ inch diameter cylinder.

The cylinders are placed in an alundum boat which is then plced in a 15 millimeter by 5 inch quartz tube. The tube is evacuated for 16 hours at 25° C and then sealed. The sealed quartz tube is then heated to approximately 805° C for 45 minutes.

The resulting $Pd_3Si$ is broken into small pieces and ground in a tungsten carbide mortar and pestle. A slurry is then prepared containing 0.10 grams of the $Pd_3Si$, 0.10 gram of a solution of titanium trichloride, $TiCt_3$, in ethanol, containing 4.5 weight percent titanium calculated as the metal, 0.10 gram of ethanol, and 0.10 gram of phenol. One coat of this slurry is applied to a titanium coupon prepared as described in Example III above. The coupon is then heated to 120° C for 60 minutes and to 400°C for 30 minutes.

When the resulting electrode, having a $Pd_3Si$ surface containing $TiO_2$, on a titanium substrate is utilized as an anode in a laboratory chlorine cell, chlorine is seen to be evolved.

It is to be understood that although the invention has been described with specific references and specific details of specific embodiments thereof, it is not to be so limited since changes and alterations therein may be made which are within the full intended scope of this invention as defined by the appended claims.

I claim:

1. In a method of electrolysis comprising the steps of feeding a brine to an electrolytic cell and causing an electrical current to flow from an anode of said electrolytic cell to a cathode of said electrolytic cell, the improvement wherein said anode consists of a surface of an electroconductive, electrocatalytic silicide chosen from the group consisting of the silicides of the platinum group metals, on a valve metal substrate.

2. The method of claim 1 wherein the surface comprises a platinum group metal and a silicide of the platinum group metal.

3. The method of claim 2 whrein the silicide is chosen from the group consisting of $Pd_3Si$, $Pt_3Si$, and $Ru_3Si_2$.

4. The method of claim 1 wherein the anode comprises a valve metal substrate, a silicide layer, and a material that is more electroconductive than the silicide interposed between and in mechanical and electrical contact with the substrate and the silicide.

5. The method of claim 1 wherein the anode comprises a valve metal substrate, a silicide layer on said substrate, and a surface comprising a catalyst on said silicide layer.

6. In an electrolytic cell having an anode, a cathode, and an external power supply means for imposing an electromotive force between said anode and said cathode, the improvement wherein said anode consists of an electroconductive, electrocatalytic silicide chosen from the group consisting of the silicides of the platinum group metals, on a valve metal substrate.

7. The electrolytic cell of claim 6 wherein the surface comprises a platinum group metal and a silicide of the platinum group metal.

8. The electrolytic cell of claim 7 wherein the silicide is chosen from the group consisting of $Pd_3Si$, $Pt_3Si$, and $Ru_3Si_2$.

9. The electrolytic cell of claim 6 wherein the anode comprises a valve metal substrate, a silicide layer, and a material that is more electroconductive than the silicide interposed between, and in electrical and mechanical contact with the silicide and the substrate.

10. The electrolytic cell of claim 6 wherein the anode comprises a valve metal substrate, a silicide layer on said substrate and a surface comprising a catalyst on said silicide layer.

* * * * *